United States Patent [19]

Brouthers

[11] 4,218,839

[45] Aug. 26, 1980

[54] FIREARM

[75] Inventor: Paul E. Brouthers, Monson, Mass.

[73] Assignee: DWA Associates Inc., Monson, Mass.

[21] Appl. No.: 929,570

[22] Filed: Jul. 31, 1978

[51] Int. Cl.[3] ..... F41C 1/00; F41C 19/00

[52] U.S. Cl. ..... 42/65

[58] Field of Search ..... 42/65, 66

[56] References Cited

U.S. PATENT DOCUMENTS

| | | | |
|---|---|---|---|
| 3,654,720 | 4/1972 | Ruger | 42/65 |
| 3,701,213 | 10/1972 | Lewis | 42/65 |
| 3,777,384 | 12/1973 | Ruger et al. | 42/66 |
| 3,810,326 | 5/1974 | Hillberg et al. | 42/66 |

*Primary Examiner*—Charles T. Jordan

*Attorney, Agent, or Firm*—Wolf, Greenfield & Sacks

[57] ABSTRACT

A revolver characterized by an improved hand, strut and transfer bar construction includes a frame, a cylinder and associated actuator for the cylinder supported in the frame, a trigger and a hammer also both mounted in the frame. The hand is pivotally supported from the trigger preferably by means of a pivot pin at the lower end of the hand. When the trigger is pulled, the hand is for operating the cylinder actuator to rotate the cylinder to the next position prior to firing. The transfer bar or connector as it is sometimes referred to is also pivotally supported at its lower end from the hand. The transfer bar is preferably supported about a mid-point of the hand intermediate the pivot support for the hand and the upper end thereof. The transfer bar cooperates with the hammer when the trigger is pulled to fire the firearm.

14 Claims, 8 Drawing Figures

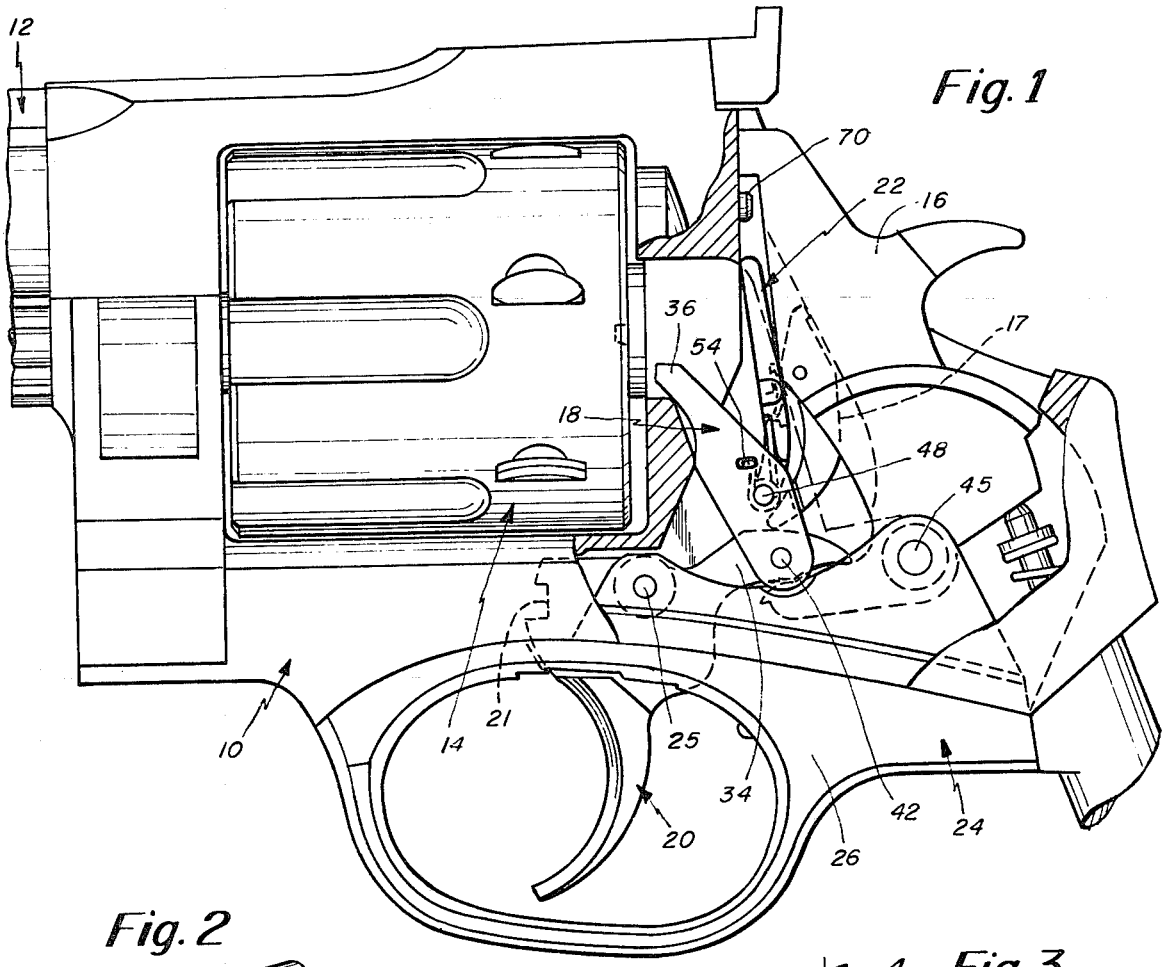
Fig. 1
Fig. 2
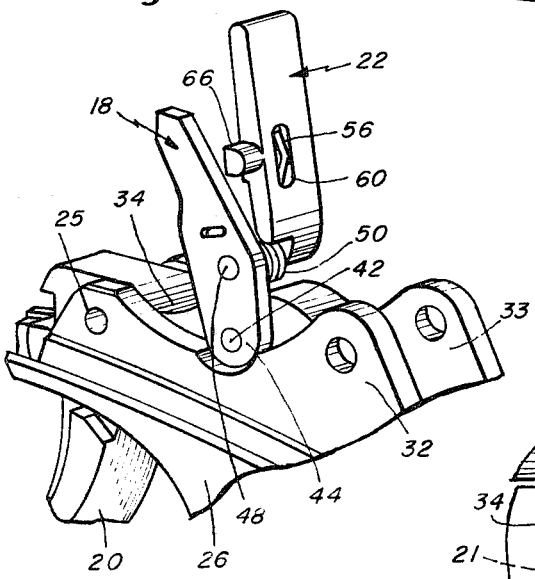
Fig. 3
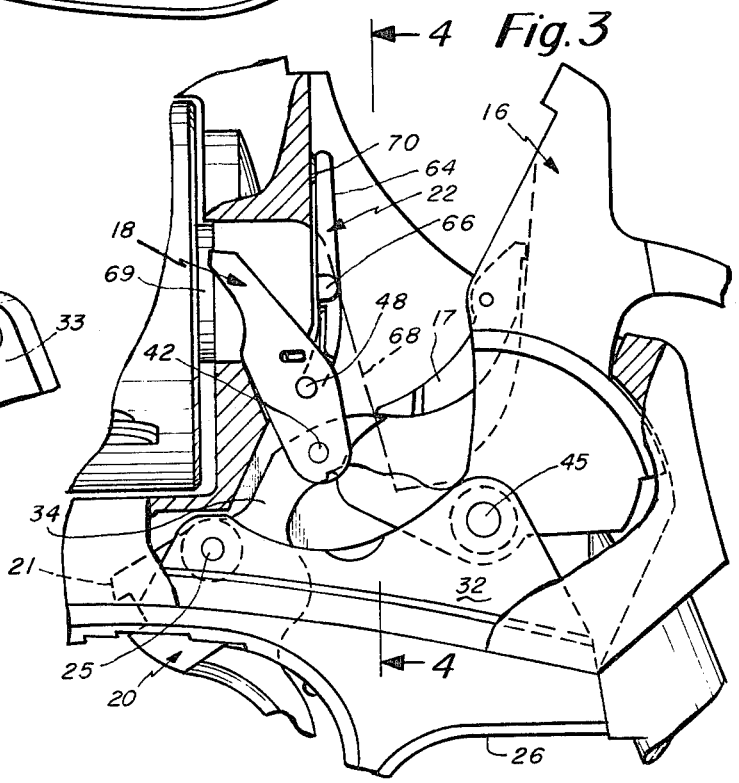

Fig. 4
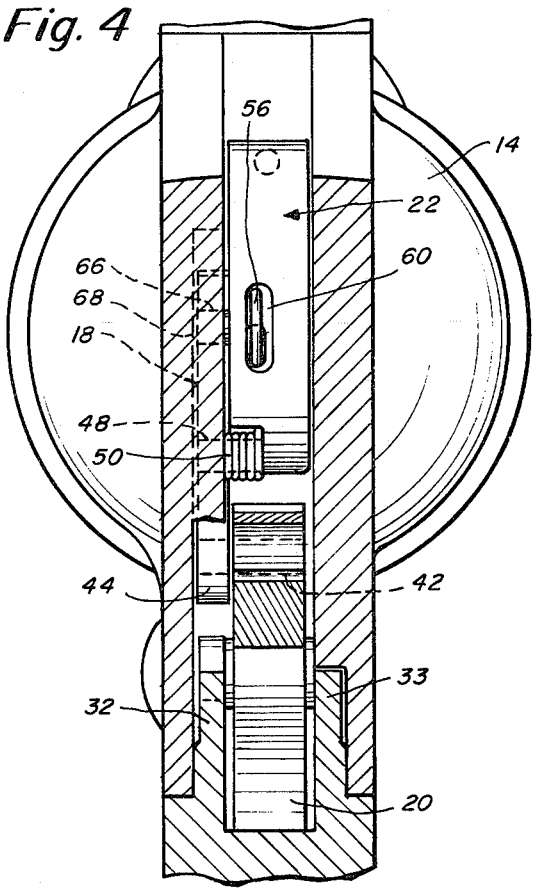
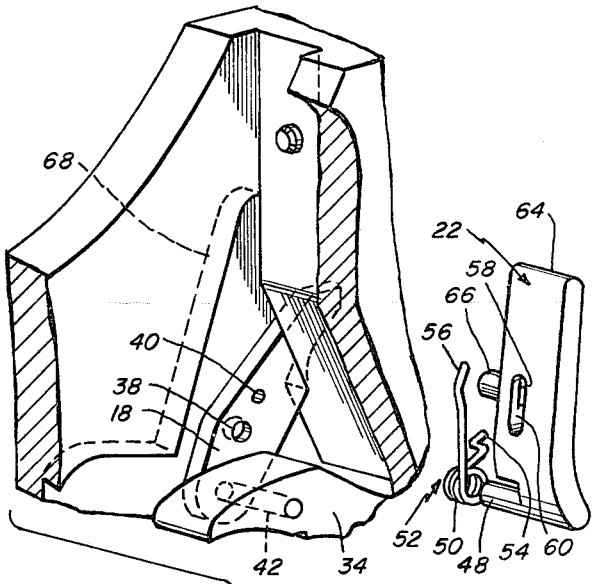
Fig. 5
Fig. 6
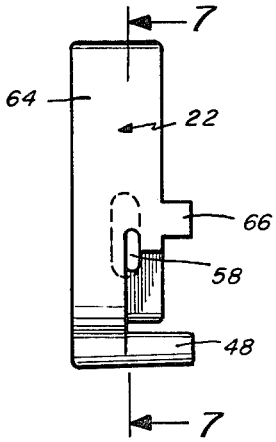
Fig. 7
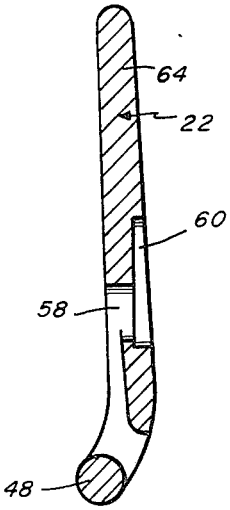
Fig. 8
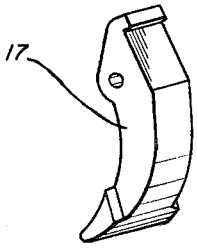

FIREARM

BACKGROUND OF THE INVENTION

The present invention relates in general to a firearm and preferably a revolver. More particularly, this invention pertains to an improved construction for the hand, strut and associated transfer bar or connector of the firearm.

In the prior art conventionally, both the transfer bar or connector and the hand are pivotally supported from the trigger usually at a top end of a trigger concealed within the frame of the firearm. A typical arrangement of this type is shown in a weapon of Dan Wesson Arms, Incorporated identified as their model 14-2 service revolver or 15-2 target revolver. Certain disadvantages have now been realized in connection with this conventional construction. For example, the transfer bar or connector must be constructed relatively long and usually has several bends in it as it must be accommodated in a relatively tight space in the frame. Also, with this conventional construction the width of the strut has to be reduced as to suitably accommodate the transfer bar. The reduction in the width of the strut is undesirable. Furthermore, with the conventional design a hand spring usually slides relative to the hand causing a possible wear problem.

Accordingly, it is an object of the present invention to provide an improved hand and transfer bar or connector construction for a firearm.

Another object of the present invention is to provide an improved hand and connector bar construction that provides a more compact overall firearm structure.

A further object of the present invention is to provide an improved firearm construction that eliminates any substantial sliding motion between the hand spring and the hand itself.

Still a further object of the present invention is to provide an improved firearm construction characterized by a transfer bar that is relatively simple in construction and that may be made substantially shorter in length than known construction of a transfer bar.

Still another object of the present invention is to provide an improved firearm construction characterized in particular by the improved construction of the hand and transfer bar or connector thus enabling use of a strut typically connected to the hammer having the same width as the top of the trigger.

Another object of the present invention is to provide an extremely compact arrangement for a firearm and one in which at least some of the components can be constructed in a relatively simple design.

SUMMARY OF THE INVENTION

To accomplish the foregoing and other objects of this invention there is provided a firearm preferably in the form of a revolver comprising as some of its basic components a frame, a cylinder and associated actuator for the cylinder supported in the frame, a trigger mounted in the frame, and a hammer also mounted in the frame. The frame defines a chamber or space disposed rearwardly of the cylinder in which it is disposed the hand and the transfer bar or connector. Means are provided for pivotally supporting the lower end of the hand from the trigger with the upper end of the hand useable for operating the cylinder actuator. The hand may be pivotally supported by means of a pivot pin which also extends through a top flange of the trigger. This top flange also typically supported the connector. However, in accordance with the present invention the connector or transfer bar is pivotally supported from the hand with the upper end of the transfer bar cooperating with the hammer when the trigger is pulled to fire the firearm. The transfer bar or connector as it is raised by pulling the trigger comes to a position intermediate the firing pin and the hammer so that when the hammer is finally released the weapon is fired. The transfer bar or connector is preferably supported in the midpoint of the hand intermediate the pivot support point for the hand and the upper end of the hand. A spring is interconnected between the hand and the transfer bar for normally biasing the upper ends of these members apart. However, in a preferred version, the transfer bar is guided by means associated with the frame so that it progresses along a predetermined path and come to a position intermediate the firing pin and the hammer. Concurrently therewith, the hand is being raised to contact the cylinder actuator or, as it is sometimes referred to, the extractor. In an alternate version of the invention, the connector may be permitted as it is raised to move rearwardly essentially with the hammer as it moves rearwardly but still being maintained between the firing pin and hammer.

BRIEF DESCRIPTION OF THE DRAWINGS

Numerous other objects, features and advantages of the invention should now become apparent upon a reading of the following detailed description taken in conjunction with the accompanying drawings, in which:

FIG. 1 is a side elevation view of the major portion of a revolver incorporating the improved hand and transfer bar or connector construction of the present invention;

FIG. 2 is a fragmentary perspective view showing further detail of the hand and transfer bar or connector;

FIG. 3 is a fragmentary cross-sectional view similar to the one shown in FIG. 1 but with the trigger pulled almost to its firing position;

FIG. 4 is a cross-sectional view taken along line 4—4 of FIG. 3;

FIG. 5 is a fragmentary perspective view with the transfer bar and associated spring exploded from the rest of the construction;

FIG. 6 is an elevation view of the transfer bar or connector shown in the drawings;

FIG. 7 is a cross-sectional view taken along line 7—7 of FIG. 6 showing the internal detail of the transfer bar or connector; and FIG. 8 shows the improved strut construction of this invention.

DETAILED DESCRIPTION

The drawings show a preferred embodiment of the present invention as embodied in a double-action revolver which comprises a frame 10, a barrel 12, a cylinder 14, a hammer 16, and a trigger 20. The principle improvement in accordance with the present invention resides in the hand 18, the strut 17 and connector or transfer bar 22. The firearm shown in the drawings may have a removable trigger guard assembly 24, the construction of which is shown in our copending application Ser. No. 913,644, filed June 8, 1978. Other components which may be of conventional design and which would typically be incorporated into the weapon are a hand grip or the like and a bolt operated from the end 21 of the trigger 20.

The removable trigger guard assembly or frame 24, in addition to including the trigger 20, also includes a trigger mounting pin 25, a trigger guard frame 26, and a trigger return spring not shown in the drawing. As part of the trigger guard frame 26 there are a pair of spaced top ears 32 and 33 clearly depicted in FIG. 2. The pin 25 extends between these ears for supporting the trigger 20 at its top flange 34. The hammer 16 is also supported from the ears 32, 33 by the pin 45 which also preferably forms a support point for the trigger guard assembly as discussed in detail in the copending application. The hammer 16 pivotally supports the strut 17. The trigger 20 is normally biased to its rest position shown in FIG. 1 by means of a return spring typically disposed within the trigger guard assembly but not shown in the drawing. FIG. 1 shows the trigger in the rest position while FIG. 3 shows the trigger 20 pulled almost to the point of firing.

The hand 18 has a top end 36, a hole 38, and a relatively small aperture 40. The hand 18 is pivotally supported by pin 42 which extends from a bottom end 44 of the hand and supports the hand pivotally from the flange 34 of the trigger 20. The pin 42 may be fixed in either the trigger or the hand but, of course, is freely rotatable in at least the hand or the trigger flange. The hole 38 in the hand receives the pivot stud 48 of the connector 22. The pivot stud 48 also supports the circular portion 50 of the interconnecting spring 52. Spring 52 basically interconnects between the hand 18 and the connector 22. In addition to the circular portion 50 of this spring, the spring also includes ends 54 and 56. The end 56 has a slight bend enabling the end to pass through the aperture 58 in the connector 22. The termination of end 56 fits within the channel 60. The other end 54 of the spring 52 is also bent and is received in the small hole 40 in the hand 18 interlocking with the hand. The spring 52 provides a bias between the hand 18 and the connector 22 tending to force the end 36 of the hand away from the top end 64 of the connector. However, the connector is provided with a cam 66 which is confined to the track 68 in the frame 10. FIG. 3 shows this track 68 which is relatively straight but arcs at the top as also indicated in the fragmentary perspective of FIG. 5. Thus, as the trigger is pulled from a position such as shown in FIG. 1 to a position as depicted in FIG. 3, the hand 18 moves upwardly along the actuator 69 to rotate the cylinder 14, and the connector 22 at the same time raises substantially vertically under control of the cam 66 and the track 68 so that the upper end 64 of the connector comes to rest adjacent the firing pin 70.

As previously mentioned, in accordance with the prior art the connector 22 usually connects all the way down to the trigger flange 34. However, in accordance with the present invention, the pivoting of the connector is at the pivot pin 48 to the hand and as can be observed in FIG. 1, there is a quite compact arrangement allowing the strut 17 to essentially fit under the bottom end of the connector 22. This arrangement also permits the strut 17 to have substantially the same width as the top of the trigger rather than a reduced width which is necessary in the prior art to provide some accommodation for the connector 22.

In the arrangement disclosed herein, the connector 22, as previously discussed, has a cam 66 for restricting the path of movement of the connector 22 to a substantially vertical path of travel. However, in accordance with an alternate version of the invention, the connector 22 may have the cam 66 removed so that under bias of the spring 52 the connector 22 moves rearwardly with the hammer when the trigger is pulled but at the same time raising to a position intermediate the hammer and the firing pin 70. In this version the connector 22 follows the hammer rearwardly to some intermediate position spaced between the hammer and the firing pin 70.

Another feature of the present invention is that the spring 52 in accordance with the present invention is substantially stationary at its ends in the hand and connector, respectively. In the prior art because both the hand and connector were pivoted from the trigger, the interconnecting spring between hand and connector were slideable relative to the hand. Thus, in accordance with the present invention a more positive spring action is provided by pivoting the connector 22 from the hand rather than from the trigger.

What is claimed is:

1. A firearm comprising;

a frame, a cylinder and associated actuator for the cylinder supported in the frame, said frame defining a chamber rearwardly of the cylinder, a trigger mounted in the frame, a hammer also mounted in the frame, a hand disposed in the chamber, means pivotally supporting the lower end of the hand from the trigger with the upper end of the hand for operating the cylinder actuator, a transfer bar disposed in the chamber, and means pivotally supporting the lower end of the transfer bar from the hand with the upper end of the transfer bar cooperating with the hammer when the trigger is pulled to fire the firearm.

2. A firearm as set forth in claim 1 including biasing means intercoupled between the hand and transfer bar for urging at least portions thereof respectively apart.

3. A firearm as set forth in claim 2 wherein said biasing means includes a coiled spring having one end interlocked with the hand and another end interlocked with the transfer bar.

4. A firearm as set forth in claim 3 wherein said transfer bar has a pivot stud engaging with the hand and forming the pivotal supporting means of the transfer bar from the hand.

5. A firearm as set forth in claim 1 wherein said trigger includes an exposed finger-engageable end external of the frame and an internal end from which the hand is pivotally supported.

6. A firearm as set forth in claim 5 wherein said pivotal supporting means for the hand to the trigger includes a pivot pin.

7. A firearm as set forth in claim 1 wherein said transfer bar includes a cam interacting with a cam track of the frame for guiding the transfer bar as it moves to a position intermediate the hammer and firing pin.

8. A firearm as set forth in claim 1 wherein the pivot for the transfer bar is at a position between the upper end of the hand and the pivot for the hand from the trigger.

9. A firearm as set forth in claim 3 wherein said coiled spring has a coiled section supported by the pivot stud.

10. A firearm as set forth in claim 9 wherein the pivot stud extends transverse to the longitudinal direction of the transfer bar.

11. For a firearm having a frame, trigger and hammer, the improvement of a hand pivotally supported from the trigger and a transfer bar pivotally supported from the hand.

12. A firearm as set forth in claim 1 including a strut and means pivotally mounting the strut from the hammer.

13. A firearm as set forth in claim 12 wherein the strut has a width comparable to the width of the hammer along at least a section thereof.

14. A firearm as set forth in claim 13 wherein the strut has its widest end contacted by the trigger.

* * * * *